United States Patent [19]

Haverly

[11] Patent Number: 4,913,078

[45] Date of Patent: Apr. 3, 1990

[54] CONVERTIBLE BANK ANCHOR AND MOORING DEVICE WITH LOCKING MEANS FOR WATERCRAFT

[76] Inventor: Howard Haverly, 9311 Independence School Rd., Fern Creek, Ky. 40291

[21] Appl. No.: 85,381

[22] Filed: Aug. 14, 1987

[51] Int. Cl.[4] ..... B63B 21/54

[52] U.S. Cl. ..... 114/221 R; 24/645; 114/230; 403/109

[58] Field of Search ..... 114/230, 221 R, 250; 403/109; 294/19.1; 24/644, 645

[56] References Cited

U.S. PATENT DOCUMENTS

| | | | |
|---|---|---|---|
| 25,372 | 4/1963 | Dick | 114/230 |
| 2,153,077 | 4/1939 | Clarke | 24/645 |
| 2,811,127 | 10/1957 | Palsson | 294/19.1 |
| 2,983,243 | 5/1961 | Bowers et al. | 114/221 R |
| 3,793,685 | 2/1974 | Knecht | 114/230 |
| 3,913,515 | 10/1975 | Hernsjo et al. | 114/221 R X |
| 4,077,349 | 3/1978 | Paul | 114/230 |
| 4,144,831 | 3/1979 | Heydolph | 114/230 |
| 4,329,076 | 5/1982 | Coreth | 403/109 |
| 4,597,354 | 7/1986 | Gelula | 114/230 |

*Primary Examiner*—Sherman D. Basinger
*Attorney, Agent, or Firm*—Scott R. Cox

[57] ABSTRACT

A convertible bank anchor and mooring device with a locking cylinder is shown for use with watercraft. The anchor has an elongated tube, or pole, having a ball and socket coupling at one end joined to the side of the boat and an inverted, downturned hook member at the opposite end of the pole for engagement with a tree bough or trunk on shore. There is a lock and key cylinder associated with the socket of the coupling to prevent the unauthorized disengagement of the coupling when the bank anchor is reversed and used as a mooring device. The hook member has a longitudinal swivel connection to the pole, and the ball and socket coupling comprises a stationary socket mechanism attached to one sidewall of the boat having a housing supporting a fixed clamping jaw and a spring-biased clamping jaw urged toward the fixed jaw to provide a female socket. The adjacent end of the pole supports a male ball pivot member having a reduced neck above the ball to be engaged between the two clamping jaws for creating a ball and socket pivoting action between the socket housing and the pole. The lock and key cylinder is in cooperation with the spring-biased clamping jaw for disabling this jaw against unauthorized disconnection of the coupling when the anchor is used as a mooring device between a boat and its dock. The hook member is a wire member that is capable of engaging a tree bough or trunk, or a piling of the boat dock. The mooring device has a ball and socket pivoting action at opposite ends which is important when the tide and waves cause the watercraft to float between high and low relative to the dock.

4 Claims, 5 Drawing Sheets

FIG. 5
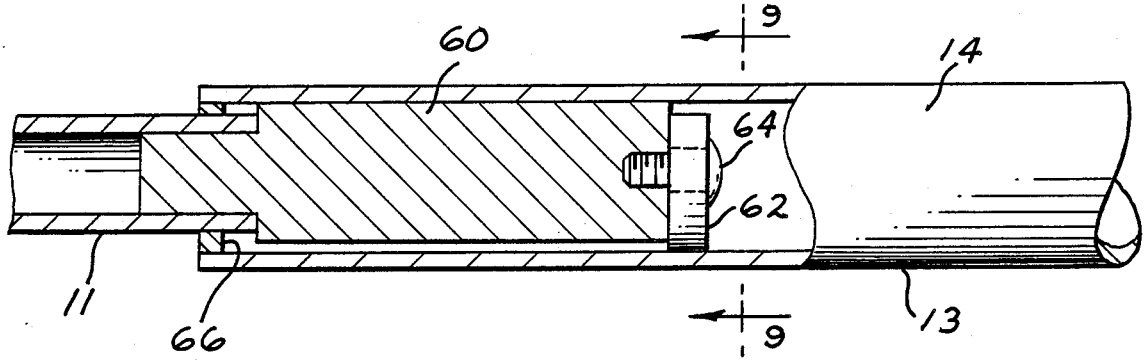
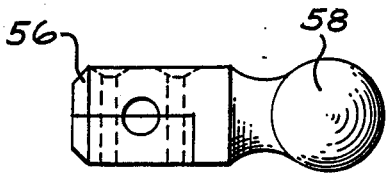
FIG. 7
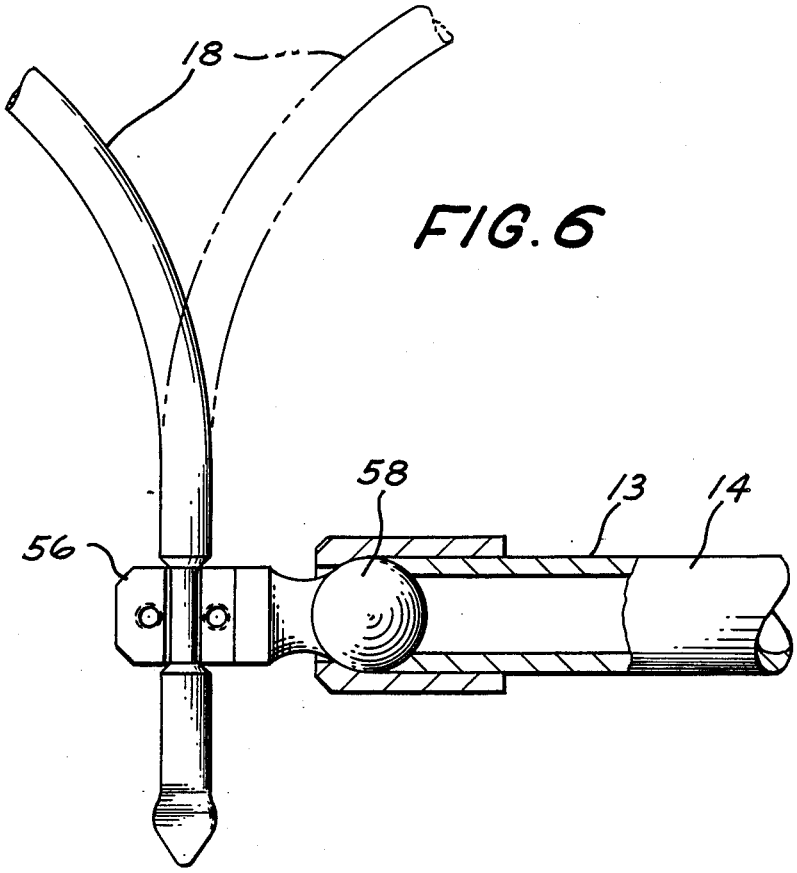
FIG. 6

CONVERTIBLE BANK ANCHOR AND MOORING DEVICE WITH LOCKING MEANS FOR WATERCRAFT

BACKGROUND OF THE INVENTION

1. Field of the Invention:

This invention relates to anchoring means and mooring means for watercraft anchoring either to a tree on the shoreline or to a dock boat slip. Much work has been done on means for anchoring a boat when the boat is unattended.

2. Description of the Prior Art:

A careful search of the prior art has been made and some of the results obtained will be discussed below. An early patent is Pat. No. 4,597,354 to Gelula. This patent teaches a self-aligning, a quick-release, coupling system useful in marine environments, and it is provided with a lock and key system so as to provide rowing and free riding, tying and lifting capabilities. This patent describes a coupling system having a male/female mating members to be joined at the option of the user. The supporting structure can be positioned in the sidewall of a small boat, and the securing end of the male connecting member connected to an oar or on a securing rope. A ball member of the male connecting member is freely rotatable between the female mating members positioned in the housing so as to provide rowing and free riding, typing and lifting capabilities. This system also includes a lock and key system that provides capability for the coupling system to be safely locked into the coupling mode or released therefrom.

Another patent is Pat. No. 4,077,349 to Paul. This patent describes a propelling device provided for propelling mooring lines from a boat to a dock or land when the boat has but a single pilot, or operator, and no deckhands for docking. The propelling device includes a projectile to which a mooring line is attached and a compressible gas or spring for propelling the projectile with the line to the dock as the boat is about to dock.

Another patent is to Dick Re. Pat. No. 25,372. This patent describes a boat mooring apparatus comprising a pair of movable mooring arms where there is a pivoted connection at the outermost end of the mooring arm. There is a male ball member and a pair of locking jaws for engaging the ball member in a ball and socket arrangement.

Another patent is Pat. No. 3,793,685 to Knecht, and it describes coupling apparatus for the moorings of boats or the like. There is a coupling device on the end of a mooring line for engaging a male coupler member supported on the dock.

Another patent is to Bowers et al Pat. No. 2,983,243, and it describes a boat anchor that includes a pull with a ratchet mechanism for operating a hook member on the ends of the pull for engaging a tree bough. Now this is a bank anchor. It's between the boat and a growth on the shoreline. This bank anchor is provided with a hooked end for engaging a remote object, and it has a slidable clamp which is ratchet-actuated to engage and securely clamp the object engaged by the hooked end of the anchor.

The last patent is to Palsson Pat. No. 2,811,127, and it describes a mooring hook which is a pole member that has an elongated handle and is operated by the deckhand for lifting a looped end of the mooring line over a piling on the dock side. This would make it unnecessary for the deckhand to jump from the boat onto the dock in order to secure the mooring line to the dock so as to anchor the boat at a boat slip.

OBJECTS OF THE PRESENT INVENTION

The principal object of the present invention is to provide watercraft with a bank anchor with a lock and key system where the anchor may also be used for mooring the boat to a dock and also mooring the boat to another boat out in the water.

A further object of the present invention is to provide a boat anchoring means that has a ball and socket connection member between the pole and the boat so that the watercraft will move with the waves or tide.

A further object of the present invention is to provide a bank anchor of the class described that is simple in design, easy and reliable in operation, and where there is no jerking as is prevalent with a rope anchor. Also, a lock and key system is added to this coupling system so as to prevent the unauthorized use of the boat when the owner is absent.

SUMMARY OF THE INVENTION

The present invention provides a boat anchor that may be used as a mooring device for watercraft. A ball and socket coupling means at one end of the pole includes a stationary socket mechanism having a housing supporting a fixed clamping jaw in a spring-biased clamping jaw cooperating with the fixed jaw to provide a female socket. The adjacent end of the pole supports a male ball member having a reduced neck above the ball to be engaged between the two clamping jaws for creating a ball and socket pivoting action between the socket housing and the pole.

BRIEF DESCRIPTION OF THE DRAWINGS

This invention will be better understood from the following description taken in conjunction with the accompanying drawings, and its scope will be pointed out in the appended claims.

FIG. 5 is a view, partly in cross section, of a connection between two telescoping tubes that form the elongated pole.

FIG. 6 shows a swivel connection between the hook member and the adjacent end of the pole member so that the hook member is capable of swiveling about a longitudinal axis of the pole.

FIG. 7 is a fragmentary view of a ball connector used in the connection of FIG. 6 between the wire member and the adjacent end of the pole to give a swivel connection about the longitudinal axis of the pole.

DESCRIPTION OF THE PREFERRED EMBODIMENTS

Figure 1:
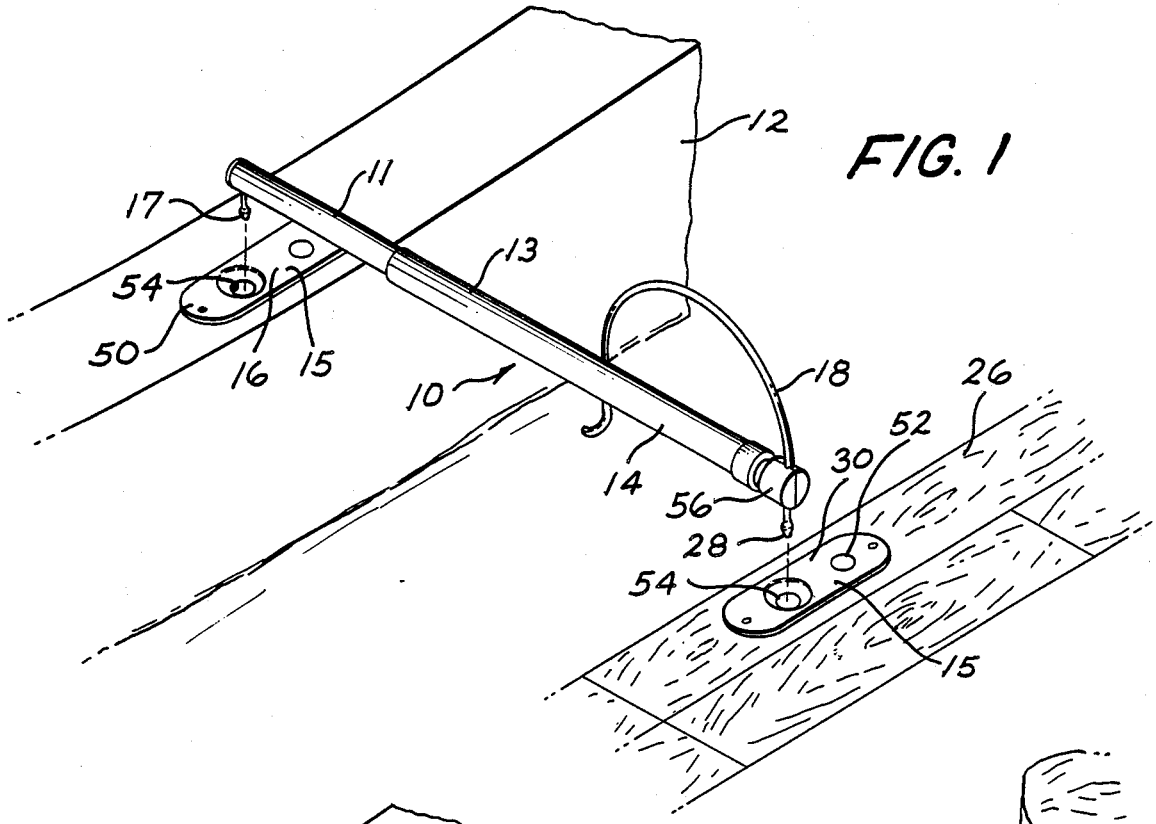
FIG. 1 is a perspective view of a mooring device between a boat and the boat dock where there is an elongated tube, or pole, aligned with a ball and socket coupling means at the end that supports the pole from the sidewall of the boat.
Figure 2:
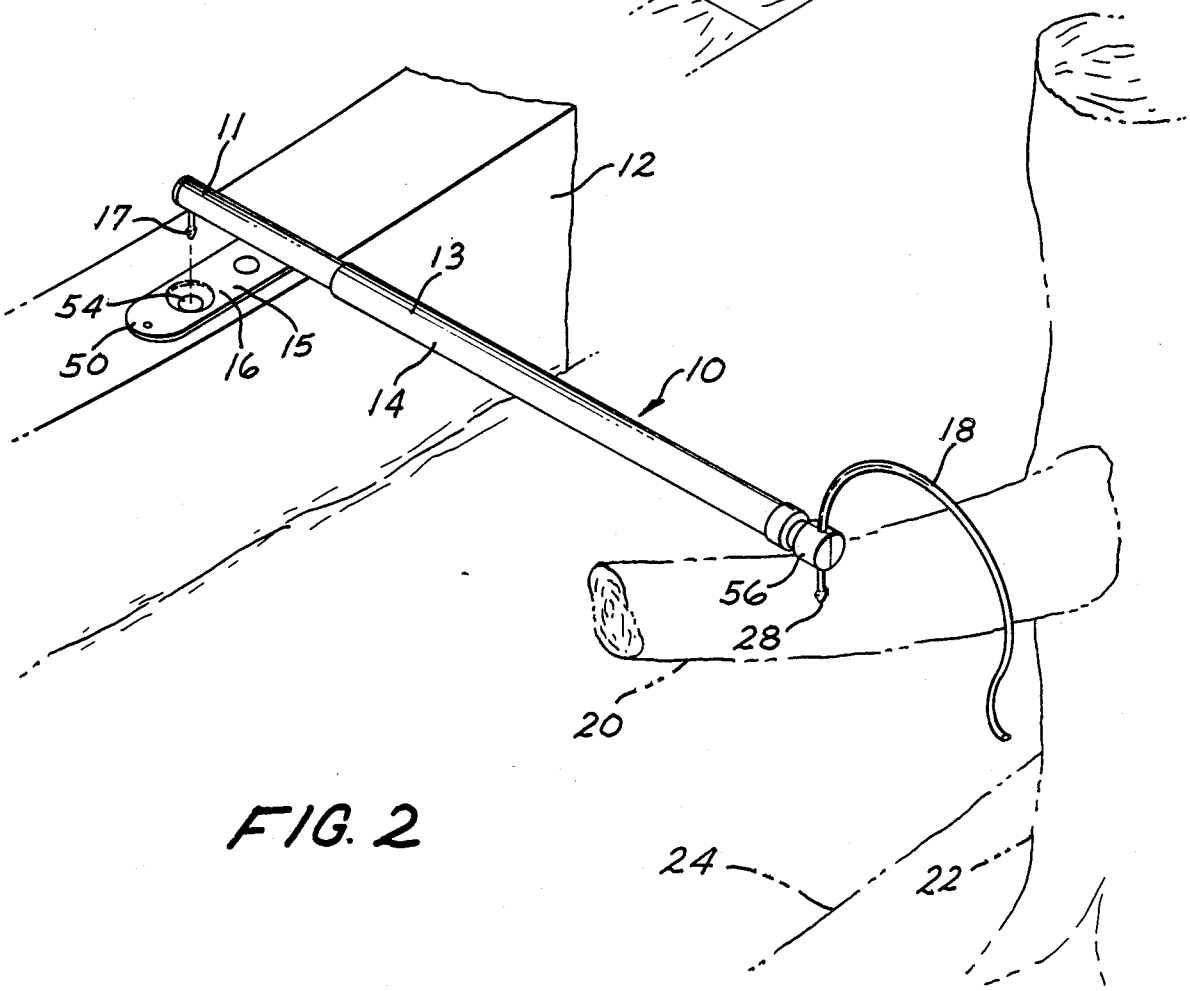
FIG. 2 is a fragmentary perspective view of the boat located near the shore where the mooring device is used instead as a bank anchor where the pole has an inverted hook member that engages over a tree bough.

Turning now to a consideration of the drawings and, in particular, to the fragmentary perspective view of FIG. 1, a boat 12, or other watercraft, is shown brought in close to the dockside 26, and there is a bank anchor 10 for use with the watercraft 12. The bank anchor 10 comprises an elongated pole 14 of telescoping metal tubes 11 and 13, and a ball and socket coupling means 16 at one one of the pole, and an inverted hook member 18 at the opposite end for engaging a tree bough 20 or a tree trunk 22 for holding the watercraft near the shoreline 24 as is seen in FIG. 2.

FIG. 1 shows the bank anchor 10 reversed end-to-end to be used as a mooring device with the dockside 26, or another watercraft. Notice, one free end of the hook member is also provided with a male ball pivot member 28 for insertion into a second socket member 30 that is fastened to the dockside 26, or to another watercraft. This socket member 30 is similar to the first socket member 15 of the ball and socket coupling means 16 at the opposite end of the pole 14 in FIG. 1. The said ball and socket coupling means 16 comprises a male ball pivot member 17 on the end of the pole 14 and a socket member 15 fastened in the top of the sidewall of the boat 12.

Figure 3:
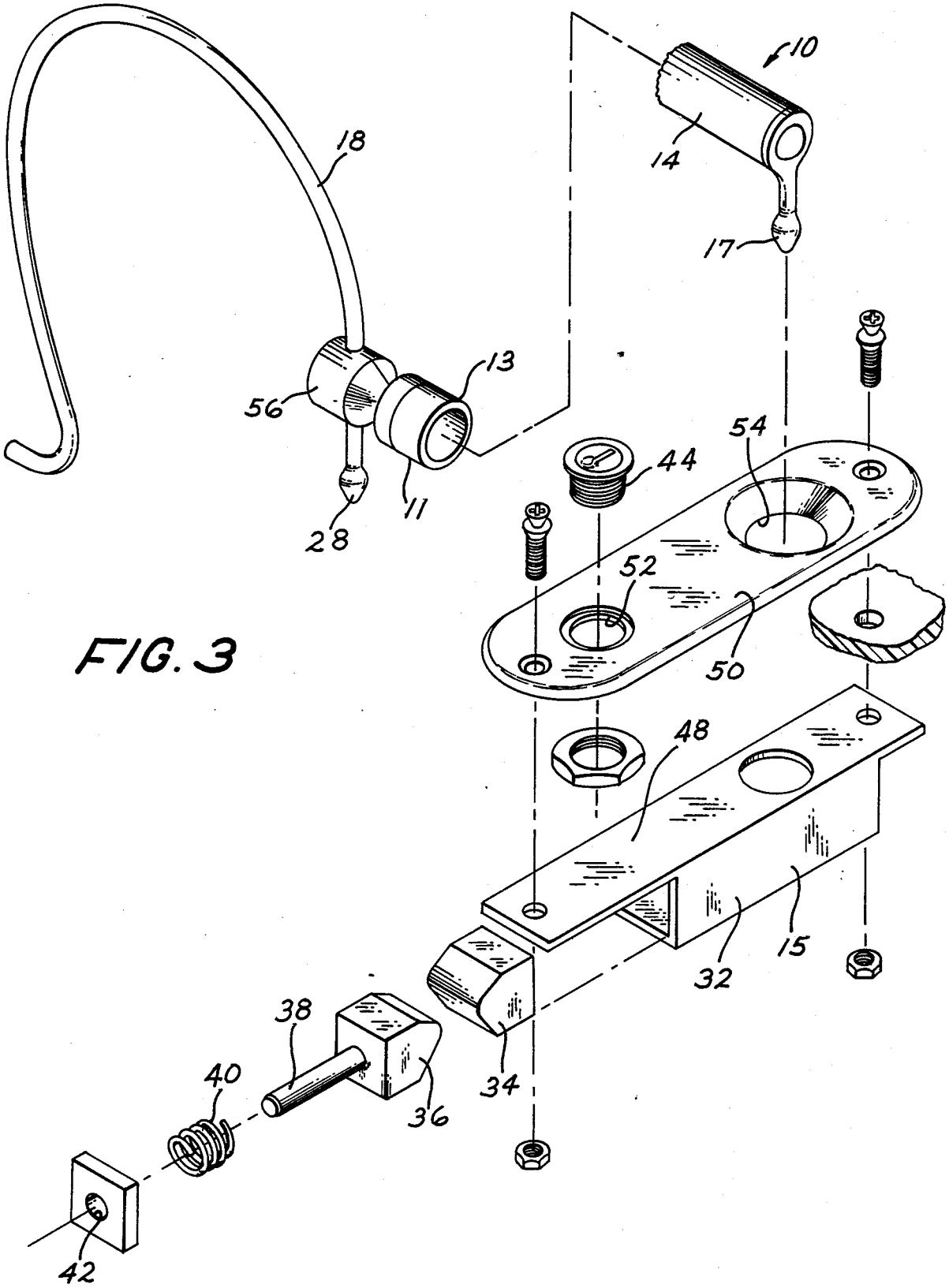
FIG. 3 is an exploded view of the stationary socket mechanism that is located on the dock side in FIG. 1. It can also be located on the sidewall of the boat as in FIG. 1.
Figure 4:
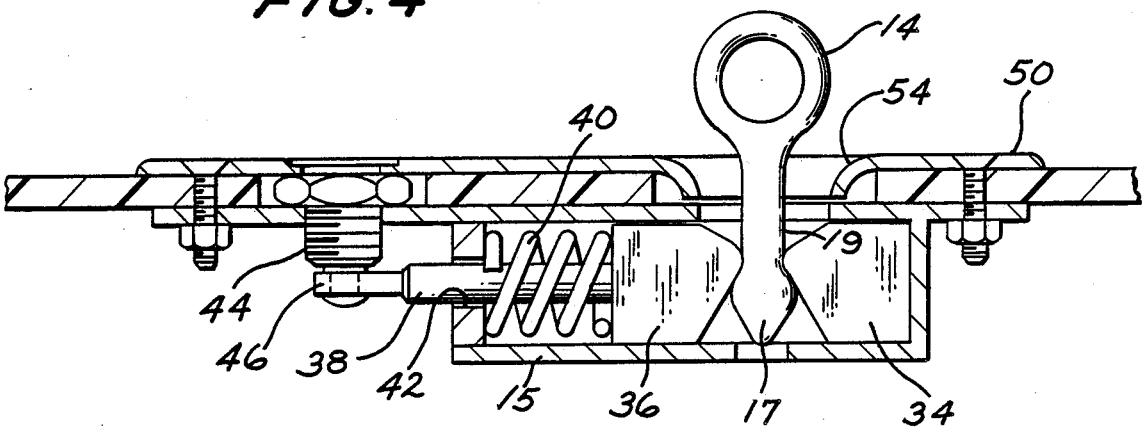
FIG. 4 is a cross-sectional elevational view through the center of the stationary socket mechanism for receiving the male ball pivot member therein for creating the ball and socket coupling member.
Figure 12:
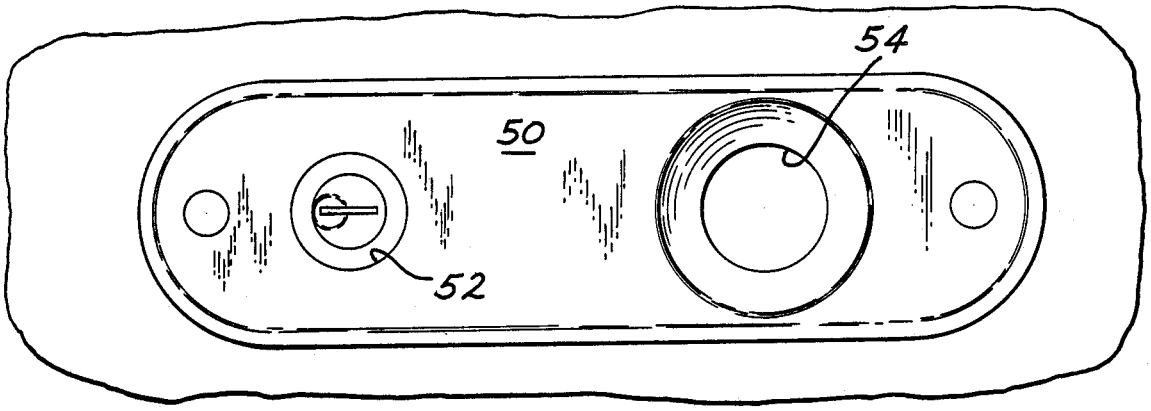
FIG. 12 is a top view of socket member 15 as shown in FIG. 4.
Figure 11:
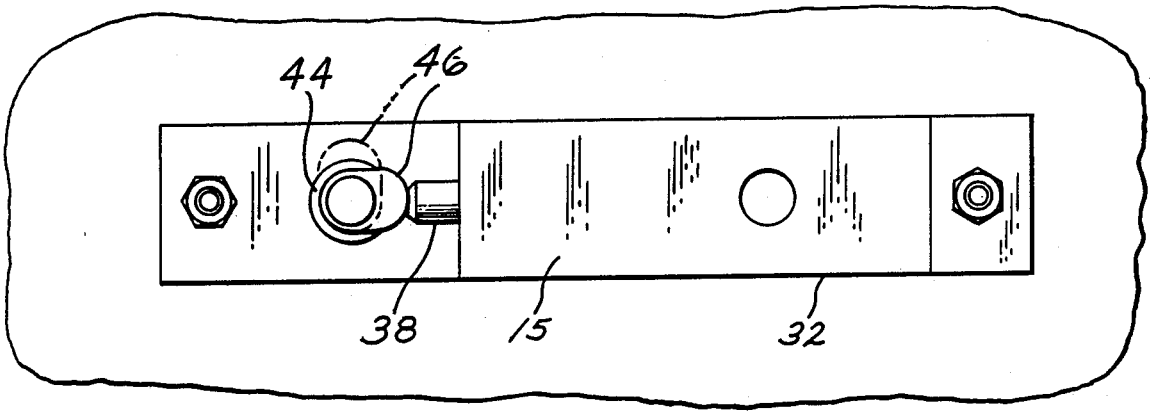
FIG. 11 is a bottom plan view of the socket member 15 as shown in FIG. 4.
Figure 10:
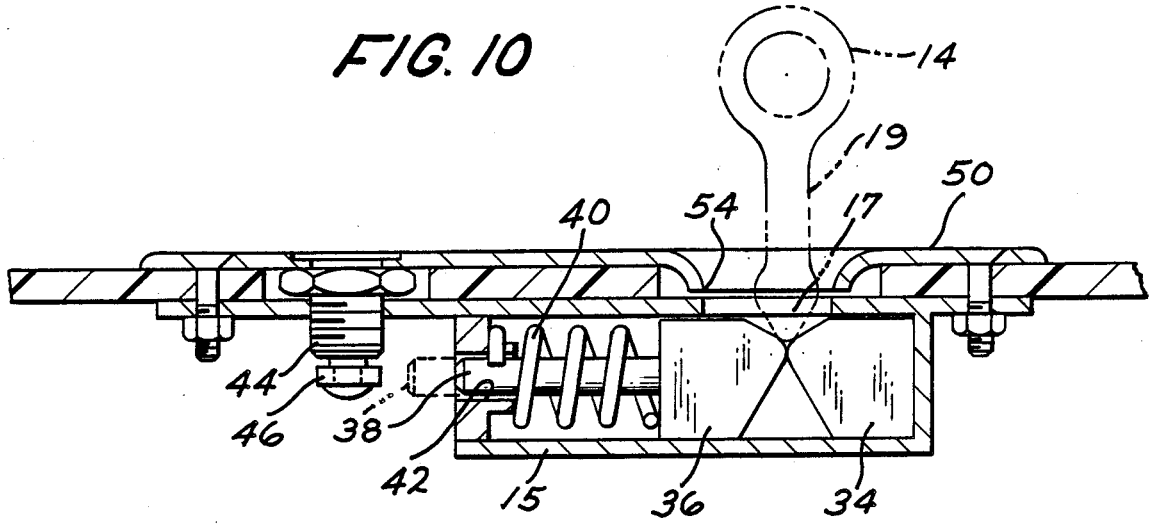
FIG. 10 is a cross-sectional view through the length of the socket member 15, similar to FIG. 4, to show the cam-shaped tip of the male ball pivoting member forcing its way between the two clamping jaws 34 and 36 for making a quick-coupling action. Moreover, the two clamping jaws are provided with tapered undersides for cooperation of the male pivot, thus obtaining a quick-release uncoupling action, and also showing cam 46 on the inner end of the shaft of the lock and key cylinder.

Turn now to a consideration of FIG. 4, which is a crosssectional view through the length of the socket member 15 of the ball and socket coupling 16. This socket member comprises a folded metal housing 32 which contains a fixed clamping jaw 34 and a spring-biased clamping jaw 36 which is normally urged toward the fixed jaw 34 for capturing the male ball pivot member 17 therebetween. This male ball pivot member 17 has a reduced neck 19 above the ball to be engaged between the two clamping jaws 34 and 36 for creating a ball and socket pivoting action between the socket housing 32 and the tube 14. There is a bolt-like member 38 extending outwardly from the spring-biased clamping jaw 36 out one end of the socket housing 32. The bolt supports a compression spring 40, and this bolt-like member extends through a mating guide hole 42 in the end wall of the housing 32, as is seen in FIG. 3. There is a lock and key cylinder 44 mounted within the socket member 15. As seen in FIG. 4, the innermost end of the shaft of the lock cylinder 44 has a cam member 46 that is in a position to restrict the movement of the bolt-like member 38 as it slides out of the housing 32. In one position of this lock cylinder the cam member 46 prevents the movement of the spring-biased clamping jaw 36 away from the fixed jaw 34. Thus, this ball and socket mechanism is disabled by the lock cylinder cam 46 against unauthorized operation of the watercraft due to the anchor pole or mooring device 14 being captured by this ball and socket coupling 16.

FIG. 3 is an exploded view of this ball and socket coupling means 16 showing the metal housing 32 for the socket member 15 and the lock and key cylinder 44 in a raised position. The top wall 48 of the metal housing 32 is covered by a face plate 50, and it has a first hole 52 for receiving the lock and key cylinder 44 and a second hole 54 for receiving the male ball pivot member 17 of the anchor device 10. Notice, the fixed clamping jaw 34 has been removed from the housing 32 as well as the spring-biased clamping jaw 36 by way of a sliding motion.

Figure 8:
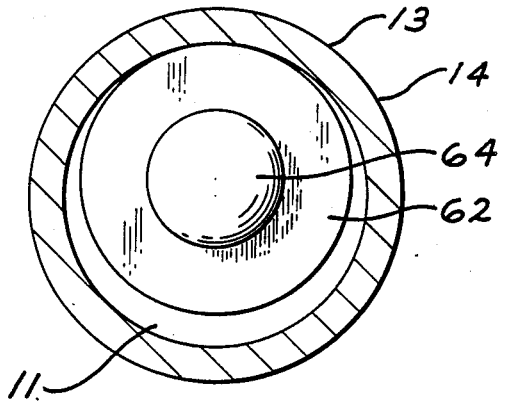
FIG. 8 is a transverse cross-sectional view taken on the Line 8--8 of FIG. 5 showing an off-center cam attached on the end of the inner tube for locking the telescoping tubes together.

FIG. 5 shows the locking connection between the inner tube 11 and the outer tube 13 of the elongated pole 14. The inner tube 11 is fitted with a shaft 60 that is inserted into the open end of the outer tube 13. The innermost end of this shaft 60 is fitted with an off-center cam 62 that is held in place by a screw fastener 64. The locking action of this off-center cam can best be understood by looking at the end view FIG. 8, which is taken on the Line 8--8 of FIG. 5. Notice the difference in the clearance around the periphery of the cam relative to the interior surface of the outer tube 13.

FIG. 6 is a view showing a longitudinal swivel connection between the pole 14 and a loose-fitting sleeve 56 for receiving the wire inverted hook member 18. This swivel connection has a male ball pivot 58 that fits within the interior of the outer tube 13 of the elongated pole 14.

FIG. 7 shows this male ball member 58 removed from the tube.

Figure 9:
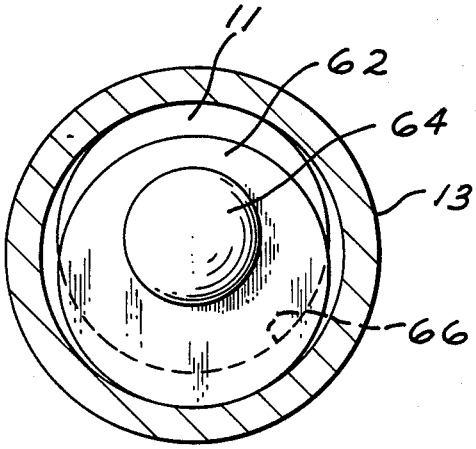
FIG. 9 is a transverse cross-sectional view, similar to FIG. 8, showing a flange in dotted lines on the interior wall of the outer tube to prevent the tubes from separating.

In FIG. 9 there is shown in dotted lines a flange 66 for capturing the off-center cam 62 within the outer tube 13 against separating therefrom.

Modifications of this invention will occur to those skilled in this art. Therefore, it is to be understood that this invention is not limited to the particular embodiments disclosed but that it is intended to cover all modifications which are within the true spirit and scope of this invention as claimed.

What is claimed is:

1. A bank anchor for watercraft comprising an elongated tube having a ball and socket coupling means at one end and an inverted hook member at the opposite end for engagement with a tree bough or trunk on shore, wherein said hook member is a wire member having two free ends, wherein said hook member is supported in a loose fitting sleeve that has a longitudinal swivel connection to the tube, and wherein a key locking means is associated with the socket of said coupling means to prevent the unauthorized disengagement thereof.

2. The bank anchor of claim 1 wherein at least one of the free ends of the wire hook member is formed as a male ball pivot member so that the tube is reversible end-for-end to be used as a mooring device when a second socket member is fastened to a dockside to receive the said ball pivot member of the wire hook member.

3. The bank anchor of claim 1 wherein the ball and socket coupling means comprises a stationary socket mechanism having a housing supporting a fixed clamping jaw and a spring-biased clamping jaw urged toward the fixed jaw to provide a female socket, while the adjacent end of the tube supports a male ball pivot member having a reduced neck above the ball to be engaged between the two clamping jaws for creating a ball and socket pivoting action between the socket housing and the tube.

4. The bank anchor of claim 3 wherein the socket housing includes a lock and key cylinder in cooperation with the spring-biased clamping jaw for disabling the jaw against unauthorized disconnection of the coupling means when the anchor is used as a mooring device between said watercraft and its dock.

* * * * *